US010559246B2

(12) United States Patent
Kim et al.

(10) Patent No.: US 10,559,246 B2
(45) **Date of Patent: *Feb. 11, 2020**

(54) METHOD OF DRIVING DISPLAY DEVICE AND DISPLAY DEVICE FOR PERFORMING THE SAME

(71) Applicant: Samsung Display Co., Ltd., Yongin-Si, Gyeonggi-Do (KR)

(72) Inventors: Jeongeun Kim, Suwon-si (KR); Jong-Woong Park, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/508,519

(22) Filed: Jul. 11, 2019

(65) Prior Publication Data

US 2019/0333438 A1 Oct. 31, 2019

Related U.S. Application Data

(63) Continuation of application No. 15/801,702, filed on Nov. 2, 2017.

(30) Foreign Application Priority Data

Nov. 2, 2016 (KR) ..... 10-2016-0145088

(51) Int. Cl.
*G09G 3/20* (2006.01)

(52) U.S. Cl.
CPC ..... *G09G 3/2003* (2013.01); *G09G 3/2074* (2013.01); *G09G 2300/0413* (2013.01); *G09G 2300/0443* (2013.01); *G09G 2310/027* (2013.01); *G09G 2310/0232* (2013.01); *G09G 2320/0242* (2013.01); *G09G 2320/0271* (2013.01)

(58) Field of Classification Search
None
See application file for complete search history.

(56) References Cited

U.S. PATENT DOCUMENTS

2011/0037785 A1* 2/2011 Shiomi ..... G09G 3/3426 345/690
2016/0253943 A1 9/2016 Wang

FOREIGN PATENT DOCUMENTS

KR 1020100027826 A 3/2010
KR 1020130051312 A 5/2013
KR 1020130109439 A 10/2013
KR 1020160081793 A 7/2016

* cited by examiner

*Primary Examiner* — Christopher J Kohlman
(74) *Attorney, Agent, or Firm* — Cantor Colburn LLP

(57) ABSTRACT

A display device includes a display panel including a plurality of pixels, the display panel having an active region in which an image is displayed and an inactive region adjacent to the active region, an image processor setting image data of the inactive region to dummy data, and performing a rendering operation for a boundary pixel of the plurality of pixels based on the dummy data to generate output image data, the boundary pixel located in the active region and adjacent to the inactive region, and a panel driver providing a driving signal to the display panel to display the image corresponding to the output image data.

17 Claims, 14 Drawing Sheets

METHOD OF DRIVING DISPLAY DEVICE AND DISPLAY DEVICE FOR PERFORMING THE SAME

This application is a continuation of U.S. patent application Ser. No. 15/801,702, filed on Nov. 2, 2017, which claims priority to Korean Patent Application No. 10-2016-0145088, filed on Nov. 2, 2016, and all the benefits accruing therefrom under 35 U.S.C. § 119, the content of which in its entirety is herein incorporated by reference.

BACKGROUND

1. Field

Exemplary embodiments of the invention relate to display devices. More particularly, exemplary embodiments of the invention relate to a method of driving a display device and a display device for performing the method.

2. Description of the Related Art

Generally, a display device includes red color sub-pixels, green color sub-pixels, and blue color sub-pixels emitting red color light, green color light, and blue color light, respectively. A combination of color lights may represent various colors. Recently, to increase a resolution of the display device, the sub-pixels may be arranged in a pentile matrix structure. In the pentile matrix structure, the red color sub-pixels and the blue sub-pixels may be alternately arranged in the same pixel column, and the green sub-pixels may be arranged in adjacent pixel column, for example.

There is an increasing demand for a display device having a curved side or a hole defined inside the display panel in order to meet functional and/or design requirements of an electronic device such as a smart clock, a smart phone, a smart device for a vehicle, etc.

SUMMARY

In a boundary (hereinafter, also referred to as an edge portion) of a display panel which has a curved side and includes sub-pixels arranged in a pentile matrix structure, problems that a band of a specific color (hereinafter, also referred to as a color band) is visible may occur.

Exemplary embodiments provide a display device capable of preventing a color band problem from occurring in the edge portion of the display panel.

Exemplary embodiments provide a method of driving the display device.

According to an exemplary embodiment, a display device may include a display panel including a plurality of pixels, the display panel having an active region in which an image is displayed and an inactive region adjacent to the active region, an image processor which sets image data of the inactive region to dummy data, and which performs a rendering operation for a boundary pixel of the plurality of pixels based on the dummy data to generate output image data, the boundary pixel located in the active region and adjacent to the inactive region, and a panel driver which provides a driving signal to the display panel to display the image corresponding to the output image data.

In an exemplary embodiment, the image processor may include an image receiver which receives first input image data corresponding to the active region, a dummy data setter which sets second input image data corresponding to the inactive region based on the dummy data, a first converter which converts the first input image data to first luminance data, and to convert the second input image data to second luminance data, a rendering processor which generates rendering data by performing the rendering operation for the boundary pixel based on the first luminance data and the second luminance data, and a second converter which converts the rendering data to the output image data.

In an exemplary embodiment, the dummy data setter may determine the dummy data as black color image data.

In an exemplary embodiment, the dummy data setter may determine the dummy data based on the first input image data.

In an exemplary embodiment, the dummy data setter may determine the dummy data such that a grayscale value of the dummy data increases as an average grayscale value of the first input image data increases.

In an exemplary embodiment, the dummy data setter may determine the dummy data as a first grayscale value when the boundary pixel is adjacent to the inactive region in a first direction, and determine the dummy data as a second grayscale value different from the first grayscale value when the boundary pixel is adjacent to the inactive region in a second direction different from the first direction.

In an exemplary embodiment, the rendering processor may perform the rendering operation for the boundary pixel using a first rendering filter when the boundary pixel is adjacent to the inactive region in a first direction, and perform the rendering operation for the boundary pixel using a second rendering filter different from the first rendering filter when the boundary pixel is adjacent to the inactive region in a second direction different from the first direction.

In an exemplary embodiment, the image processor further may include an arrangement data storage including a look-up table representing position data of the boundary pixel as pixel arrangement data, and a dimming processor which performs a dimming operation for the first input image data corresponding to the boundary pixel based on the pixel arrangement data.

In an exemplary embodiment, the dimming operation may have a first dimming level when the boundary pixel is adjacent to the inactive region in a first direction, and has a second dimming level different from the first dimming level when the boundary pixel is adjacent to the inactive region in a second direction different from the first direction.

In an exemplary embodiment, the dimming processor may perform the dimming operation for one of sub-pixels included in the boundary pixel.

In an exemplary embodiment, the display panel may include a pixel array in which a first pixel of the plurality of pixels including a first sub-pixel and a second sub-pixel and a second pixel of the plurality of pixels including a third sub-pixel and a fourth sub-pixel are alternately arranged. The first sub-pixel may emit a first color light, the third sub-pixel emits a second color light, and the second sub-pixel and the fourth sub-pixel emit a third color light. The first through third color lights may be different from each other.

According to an exemplary embodiment, a method of driving a display device may include an operation of receiving first input image data corresponding to the active region, an operation of setting second input image data corresponding to the inactive region to dummy data, an operation of converting the first input image data to first luminance data and converting the second input image data to second luminance data, an operation of performing a rendering operation for a boundary pixel of the plurality of pixels based on the first luminance data and the second luminance data to generate output image data, the boundary pixel located in the active region and adjacent to the inactive region, and an operation of displaying the image corresponding to the output image data.

In an exemplary embodiment, the dummy data may correspond to black color image data.

In an exemplary embodiment, grayscale values of the dummy data may increase as an average grayscale value of the first input image data increases.

In an exemplary embodiment, the dummy data may be determined as a first grayscale value when the boundary pixel is adjacent to the inactive region in a first direction, and may be determined as a second grayscale value different from the first grayscale value when the boundary pixel is adjacent to the inactive region in a second direction different from the first direction.

In an exemplary embodiment, the rendering operation for the boundary pixel may use a first rendering filter when the boundary pixel is adjacent to the inactive region in a first direction, and may use a second rendering filter different from the first rendering filter when the boundary pixel is adjacent to the inactive region in a second direction different from the first direction.

In an exemplary embodiment, the method of driving the display device may further include an operation of performing a dimming operation for the first input image data corresponding to the boundary pixel based on pixel arrangement data.

In an exemplary embodiment, the dimming operation may have a first dimming level when the boundary pixel is adjacent to the inactive region in a first direction, and has a second dimming level different from the first dimming level when the boundary pixel is adjacent to the inactive region in a second direction different from the first direction.

In an exemplary embodiment, the dimming operation may be for one of sub-pixels included in the boundary pixel.

According to an exemplary embodiment, a method of driving a display device may include an operation of setting image data of the inactive region to dummy data, an operation of performing a rendering operation for a boundary pixel of the plurality of pixels based on the dummy data to generate output image data, an operation of the boundary pixel located in the active region and adjacent to the inactive region, and an operation of displaying the image corresponding to the output image data.

Therefore, a display device according to exemplary embodiments may set image data of the inactive region to dummy data and may perform the rendering operation for the boundary pixel using image data of the inactive region (i.e., the dummy data), the boundary pixel located in the active region and adjacent to the inactive region. Accordingly, the color band is visible in the edge portion of the display panel may be prevented. In addition, the display device may further perform the dimming operation for image data of the boundary pixel based on the pixel arrangement data, thereby improving an image distortion in the edge portion of the display panel.

Further, a method of driving the display devices of which the edge portions have various shapes may solve problems that the color band is visible in the edge portion and improve a display quality.

BRIEF DESCRIPTION OF THE DRAWINGS

Exemplary embodiments, advantages and features of the disclosure will be described more fully hereinafter with reference to the accompanying drawings, in which.

DETAILED DESCRIPTION

Figure 1:
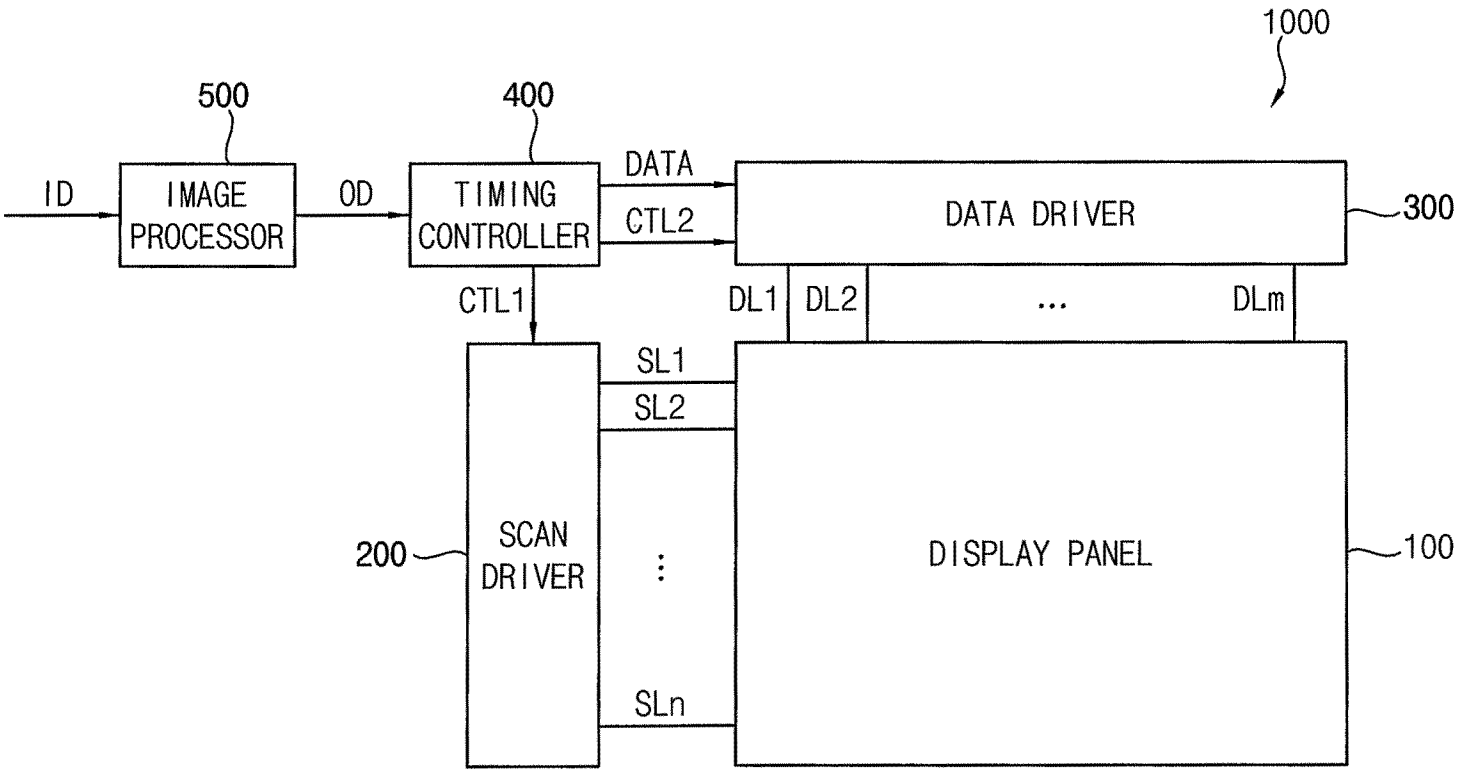
FIG. 1 is a block diagram illustrating an exemplary embodiment of a display device.

Exemplary embodiments will be described more fully hereinafter with reference to the accompanying drawings, in which various embodiments are shown.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/ or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display device according to exemplary embodiments.

Referring to FIG. 1, the display device 1000 may include a display panel 100, a panel driver, and an image processor 500. The panel driver may receive output image data OD from the image processor 500, and may provide a driving signal to the display panel 100 to display an image corresponding to the output image data OD. The panel driver may include a scan driver 200, a data driver 300, and a timing controller 400. In one exemplary embodiment, the display device 1000 may be an organic light emitting display device.

The display panel 100 may include a plurality of pixels. The display panel 100 may be divided into an active region in which an image is displayed and an inactive region adjacent to the active region. The image may be displayed in the active region to be recognized by user. The inactive region may be a region other than the active region of the display panel. In the inactive region, the image may not be displayed or may not be recognized by the user. In an exemplary embodiment, the inactive region may be a region generated by bending of the display panel and may be invisible to the user, for example. In an exemplary embodiment, the inactive region may have a bent shape so as to be invisible to the user, or may be a virtual region in which pixels are not formed, for example. In one exemplary embodiment, the display panel 100 may have the pixels arranged in a pentile matrix structure. The shape and pixel arrangement of the display panel 100 will be described in detail with reference to FIGS. 3A, 3B, 9A, 9B, 10A, and 10B.

The scan driver 200 may provide a scan signal to the pixels through scan lines SL1 through SLn based on a first control signal CTL1 where n is a natural number.

The data driver 300 may receive a second control signal CTL2 and image data DATA. The data driver 300 may convert the image data DATA into analog data signals based on the second control signal CTL2 and provide the converted data signals to the pixels through data lines DL1 to DLm where m is a natural number.

The timing controller 400 may receive output image data OD from the image processor 500. The timing controller 400 may generate the first and second control signals CTL1 and CTL2 to control the scan driver 200 and the data driver 300, respectively. In an exemplary embodiment, the first control signal CTL1 for controlling the scan driver 200 may include a vertical start signal, a scan clock signal, etc., for example. The second control signal CTL2 for controlling the data driver 300 may include a horizontal start signal, a load signal, etc., for example. The timing controller 400 may generate type digital type data signal DATA matching an operation condition of the display panel 100 based on the output image data OD, and then provide the data signal DATA to the data driver 300.

The image processor 500 may set image data of the inactive region to dummy data and may perform a rendering operation for a boundary pixel using the image data of the inactive region (i.e., the dummy data) to generate the output image data OD. Here, the boundary pixel indicates a pixel located in the active region and adjacent to the inactive region. Thus, the image processor 500 may perform the rendering operation for the boundary region between the active region and the inactive region (i.e., the boundary pixel) using the dummy data of the inactive region. Therefore, the image processor 500 may prevent a problem that a color band is visible, the color band problem may occur in the display panel 100 having the pentile matrix structure. In an exemplary embodiment, the image processor 500 may receive input image data ID from an external image source device, may set image data of the active region to the input image data ID, may set image data of the inactive region to the dummy data (e.g., black color image data), and may perform the rendering operation for the boundary pixel using the image data of the active region and the inactive region, for example. In addition, the image processor 500 may prevent an image distortion of the boundary region between the active region and the inactive region of the display panel 100 by performing the dimming operation for the image data of the boundary pixel.

Figure 2:
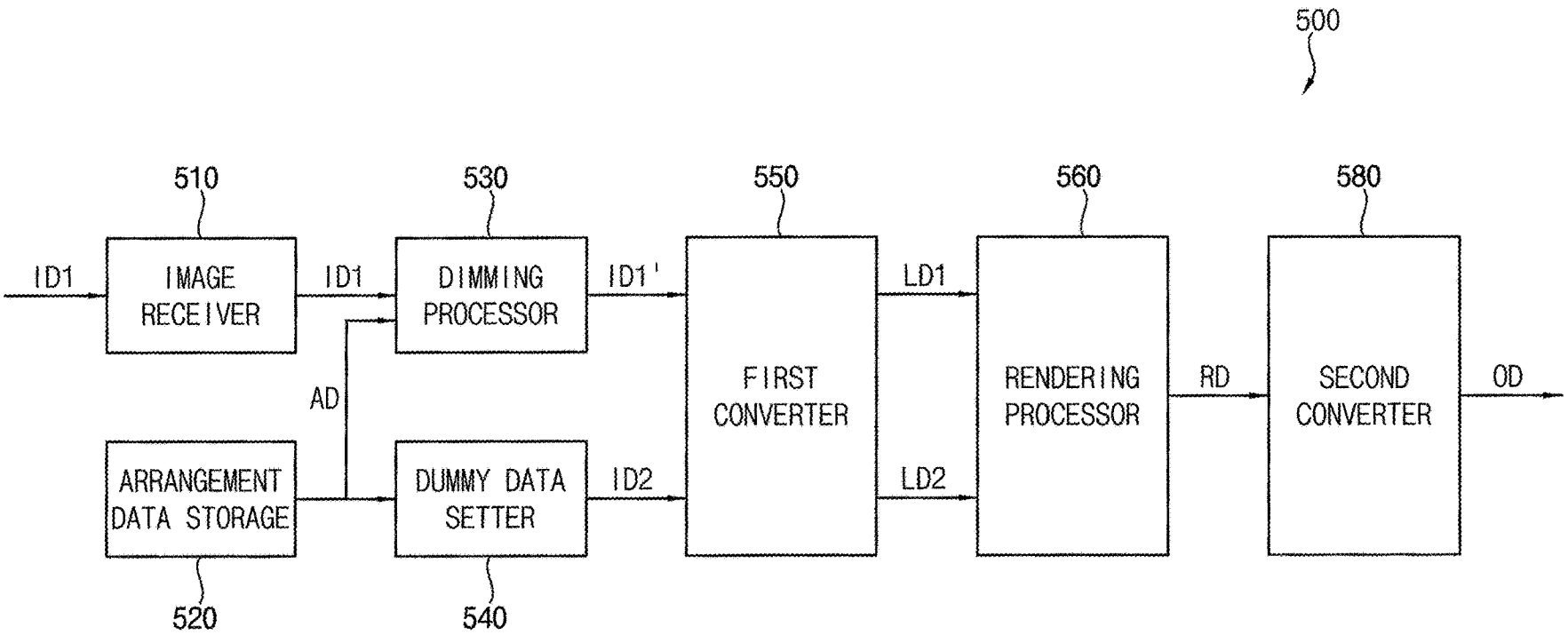
FIG. 2 is a block diagram illustrating an example of an image processor included in the display device of FIG. 1.

FIG. 2 is a block diagram illustrating an example of an image processor included in the display device of FIG. 1.

Referring to FIG. 2, the image processor 500 may include an image receiver 510, an arrangement data storage 520, a dimming processor 530, a dummy data setter 540, a first converter 550, a rendering processor 560, and a second converter 580.

The image receiver 510 may receive first input image data ID1 corresponding to the active region and may provide the first input image data ID1 to the dimming processor 530. In an exemplary embodiment, the image receiver 510 may receive the first input image data ID1 from an image source device that loads image data stored in a storage device, for example.

The arrangement data of the pixels included in the display panel (i.e., pixel arrangement data) are stored in the arrangement data storage 520. In an exemplary embodiment, the arrangement data storage 520 may include a non-volatile memory device such as an erasable programmable read-only memory ("EPROM") device, an electrically erasable programmable read-only memory ("EEPROM") device, a flash memory device, a phase change random access memory ("PRAM") device, etc., for example. The arrangement data storage 520 may store the position data of the boundary pixel as the pixel arrangement information AD. The position data of the boundary pixel may be used for distinguishing the active region and the inactive region, and for determining the boundary pixel and the boundary sub-pixel. In one exemplary embodiment, the arrangement data storage 520 may include a look-up table that stores position data of boundary pixels as pixel arrangement data AD. The arrangement data storage 520 may provide the pixel arrangement data AD to the dimming processor 530 and the dummy data setter 540.

The dimming processor 530 may perform a dimming operation for the first input image data ID1 corresponding to the boundary pixel based on the pixel arrangement data AD. The dimming processor 530 may perform the dimming operation for the first input image data ID1 corresponding to the boundary pixel based on the pixel arrangement data AD to lower a luminance of the boundary pixel or the boundary sub-pixel.

In one exemplary embodiment, the dimming operation may have different dimming levels depending on the direction in which the boundary pixels are adjacent to the inactive region. Thus, the dimming operation may have a first dimming level when the boundary pixel is adjacent to the inactive region in the first direction. The dimming operation may have a second dimming level different from the first dimming level when the boundary pixel is adjacent to the inactive region in the second direction different from the first direction. Due to the characteristics of the rendering filters, adjusted degrees of luminance of the boundary pixels by the rendering operation may be changed depending on the direction in which the boundary pixel is adjacent to the inactive region. Therefore, in order to reduce the deviation of the adjusted degrees of luminance of the boundary pixels, the dimming operation may have different dimming levels depending on the direction in which the boundary pixels are adjacent to the inactive region. In an exemplary embodiment, when the boundary pixel is adjacent to the inactive region in the first direction, the dimming level may be set such that the luminance is decreased by about 15 percent (%), for example. When the boundary pixel is adjacent to the inactive region in the second direction, the dimming level may be set such that the dimming operation is not performed.

In one exemplary embodiment, the dimming processor 530 may perform the dimming operation for a selected one of sub-pixels included in the boundary pixel. In an exemplary embodiment, in a region in which a green color band is expected to be visible among the edge portion of the display panel, the dimming operation for green color sub-pixels may be performed, for example.

The dummy data setter 540 may set second input image data ID2 of the inactive region to the dummy data based on the pixel arrangement data AD. The dummy data setter 540 may provide the second input image data ID2 to the first converter 550. In one exemplary embodiment, the dummy data setter 540 may determine the dummy data as black color image data. In this case, the luminance of the boundary pixels may be constantly reduced by the rendering operation. In another exemplary embodiment, the dummy data setter 540 may determine the dummy data based on the first input image data ID1 (or the dimmed first input image data ID1'). In this case, because the dummy data are determined according to the luminance of an image displayed in the active region, the luminance of the boundary pixels may be decreased to be appropriately adjusted according to the image displayed in the active region. In an exemplary embodiment, the dummy data setter 540 may set the dummy data such that a grayscale value of the dummy data increases as an average grayscale value of the first input image data ID1 (or the dimmed first input image data ID1') increases, for example.

In one exemplary embodiment, the dummy data setter 540 may determine the dummy data as a first grayscale value when the boundary pixel is adjacent to the inactive region in a first direction, and may determine the dummy data as a second grayscale value different from the first grayscale value when the boundary pixel is adjacent to the inactive region in a second direction different from the first direction. In order to reduce the deviation of the adjusted degree of luminance of the boundary pixels depending on the direction in which the boundary pixels are adjacent to the inactive region, the dummy data may be determined as different grayscale values according to the direction in which the boundary pixels are adjacent to the inactive region in consideration of characteristics of the rendering filter.

The first converter 550 may convert the dimmed first input image data ID1' (or the first input image data ID1) to first luminance data LD1, and may convert the second input image data ID2 to second luminance data LD2. In an exemplary embodiment, the first converter 550 may convert the first and second input image data ID1' and ID2 to the first and second luminance data LD1 and LD2, respectively, using a mathematical expression or a look-up table that indicate a relation between a grayscale value and luminance, for example.

The rendering processor 560 may generate rendering data RD by performing the rendering operation for the boundary pixel based on the first luminance data LD1 and the second luminance data LD2. In an exemplary embodiment, the rendering processor 560 may derive the first luminance data LD1 of the boundary pixel and the second luminance data LD2 of a pixel adjacent to the boundary pixel from the line memory, for example. The rendering processor 560 may generate the rendering data RD for the boundary pixels by applying a rendering filter to the first luminance data LD1 and the second luminance data LD2. In one exemplary embodiment, the rendering processor 560 may perform the rendering operation for the boundary pixel using a first rendering filter when the boundary pixel is adjacent to the inactive region in a first direction, and may perform the rendering operation for the boundary pixel using a second rendering filter different from the first rendering filter when the boundary pixel is adjacent to the inactive region in a second direction different from the first direction. Thus, in order to reduce the deviation of the adjusted degree of luminance of the boundary pixels depending on the direction in which the boundary pixels are adjacent to the inactive region, the rendering processor 560 may perform the rendering operation using different rendering filter depending on the direction in which the boundary pixels are adjacent to the inactive region.

The second converter 580 may convert the rendering data RD to the output image data OD. In an exemplary embodiment, the second converter 580 may convert the rendering data RD to the output image data OD including grayscale data using a mathematical expression or a look-up table that indicate a relation between a grayscale value and luminance, for example.

Although the exemplary embodiments of FIG. 2 describe that the dimming processor 530 of the image processor 500 may perform a dimming operation for the first input image data ID1, the invention is not limited thereto. In an exemplary embodiment, the image processor does not include the dimming processor, and the first converter converts the first input image data received directly from the image receiver to the first luminance data, for example.

Figure 3A:
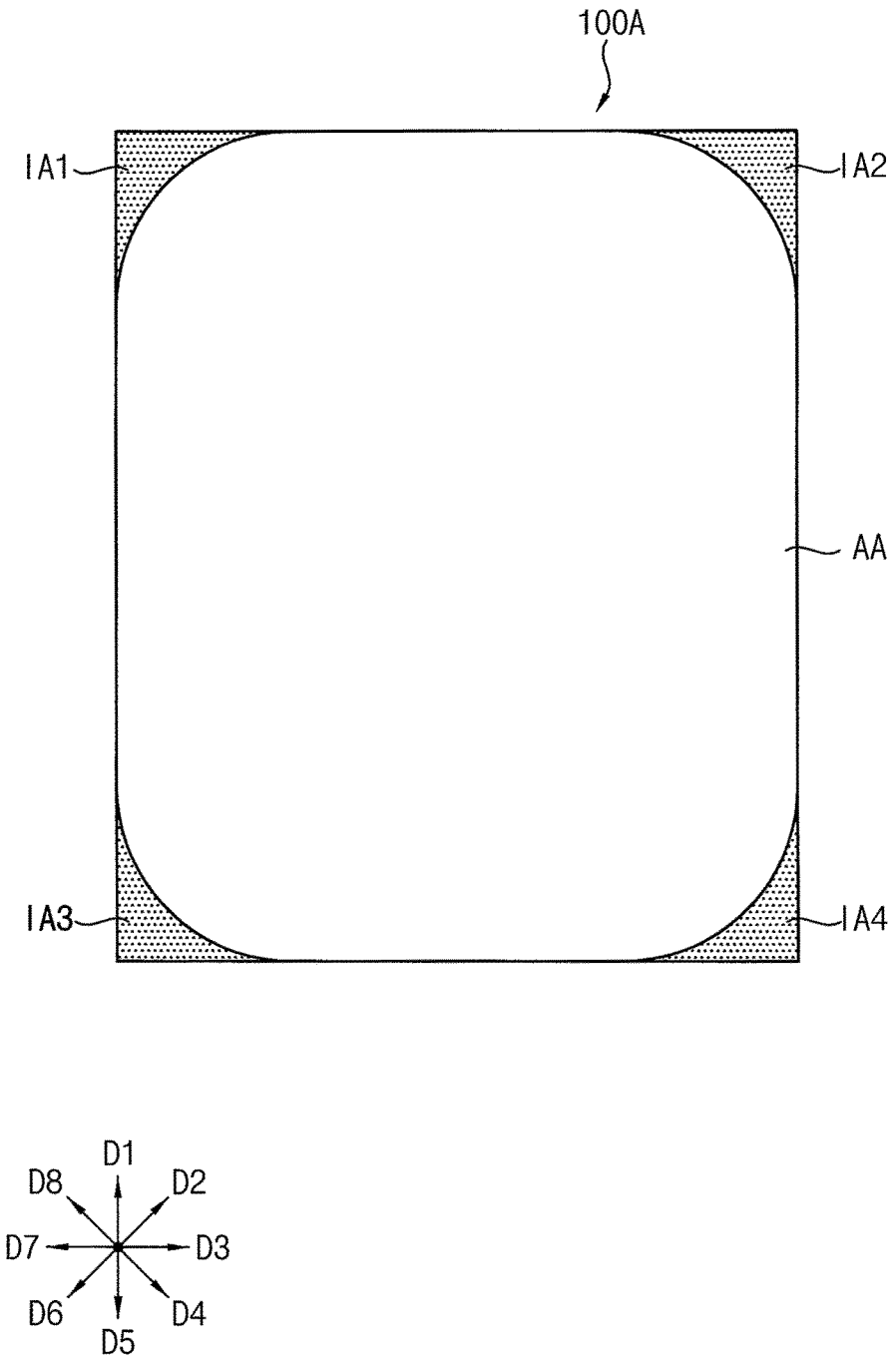
FIGS. 3A and 3B are diagrams illustrating one example of a display panel included in a display device of FIG. 1.
Figure 3B:
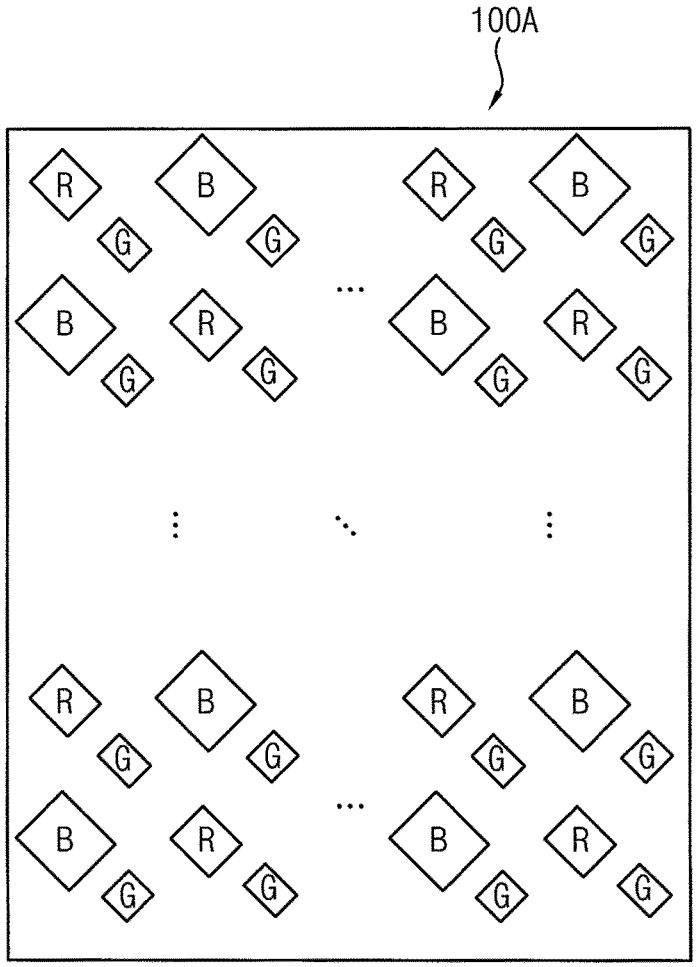
Figure 3B:
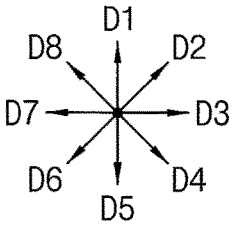

FIGS. 3A and 3B are diagrams illustrating one example of a display panel included in a display device of FIG. 1.

Referring to FIGS. 3A and 3B, the display panel 100A may include pixels arranged in a pentile matrix structure, and may be divided into an active region AA in which an image is displayed and an inactive region IA1 through IA4 adjacent to the active region AA.

As shown in FIG. 3A, the display panel 100A may include the active region AA and the first through fourth inactive regions IA1 through IA4. In one exemplary embodiment, the first through fourth inactive regions IA1 through IA4 may be folded inwardly so as to be invisible to the user. In another exemplary embodiment, the first through fourth inactive regions IA1 through IA4 may be virtual regions generated by cutting off the display panel 100A.

As shown in FIG. 3B, the display panel 100A may include a pixel array in which a first pixel including a red color sub-pixel R and a green color sub-pixel G and a second pixel including a blue color sub-pixel B and a green color sub-pixel G are alternately arranged (hereinafter, referred to as an RGBG pentile matrix structure).

The color band may be recognized by the user due to the asymmetrical pixel arrangement at the boundary (hereinafter, also referred to as edge portion) of the active region AA. In an exemplary embodiment, in the edge portion having a straight line shape of the active region AA located in the third and fifth directions D3 and D5, green color sub-pixels may be arranged in a straight line, for example. Also, in the edge portion having a straight line shape of the active region AA located in the first and seventh directions D1 and D7, red color sub-pixels and blue color sub-pixels may be alternately arranged in a straight line. Accordingly, the color band may be recognized by the user in the edge portions having the straight line shape. Similarly, the color band may be recognized by the user due to the asymmetrical pixel arrangement at the edge portion having a curved line shape of the active region AA adjacent to the first through fourth inactive regions IA1 through IA4. Therefore, the image processor may perform the dimming operation or the rendering operation for the edge portion, thereby preventing a problem that the color band is visible.

Figure 4:
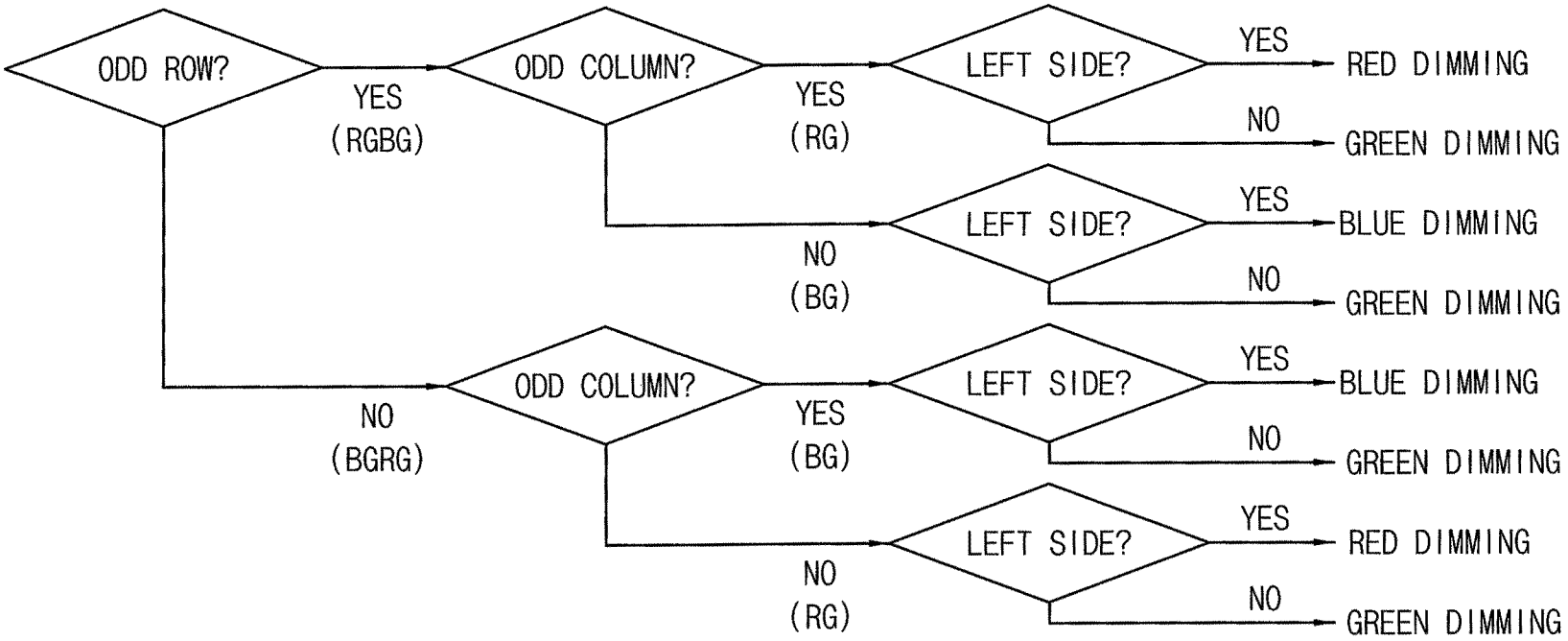
FIGS. 4 and 5 are diagrams for describing that an image processor of FIG. 2 performs a dimming operation for a boundary pixel based on a pixel arrangement.
Figure 5:
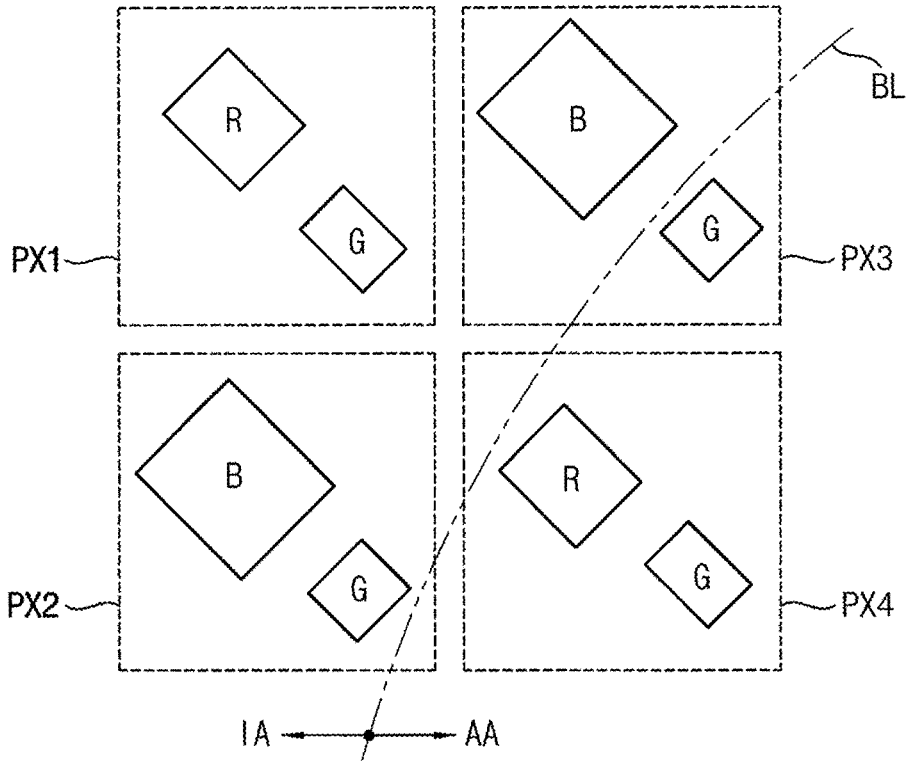

FIGS. 4 and 5 are diagrams for describing that an image processor 500 of FIG. 2 performs a dimming operation for a boundary pixel based on a pixel arrangement.

Referring to FIGS. 4 and 5, the dimming operation for the boundary pixels may be performed based on the pixel arrangement data AD (refer to FIG. 2).

Since a pixel structure (i.e., sub-pixels arrangement) of single pixel is determined according to the position of the pixel in the display panel having the pentile matrix structure, the position data of the boundary pixels included in the display panel may be stored to determine the boundary pixels and/or the boundary sub-pixels. In an exemplary embodiment, the position data of the boundary pixels may be stored as a look-up table according to [TABLE 1] during manufacturing process (or initializing process) of the display device, for example.

TABLE 1

| ROW | COLUMN | L/R |
|---|---|---|
| 1500 | 2 | 0 |
| 1500 | 3 | 0 |
| 1500 | 4 | 0 |
| | . . . | |
| 1900 | 99 | 1 |
| 1900 | 100 | 1 |

where ROW indicates a pixel row of the boundary pixel, COLUMN indicates a pixel column of the boundary pixel, and L/R indicates a sub-boundary flag for determining whether the boundary sub-pixel. Here, when the sub-boundary flag is 1, a left sub-pixel among the sub-pixels included in the boundary pixel may be the boundary sub-pixel. When the sub-boundary flag is 0, a right sub-pixel among the sub-pixels included in the boundary pixel may be the boundary sub-pixel.

As shown in FIG. 4, in the display panel in which pixels are arranged in the RGBG pentile matrix structure, the dimming processor 530 (refer to FIG. 2) may perform a dimming operation for a selected one of the sub pixels included in the boundary pixels based on the position data of the boundary pixels. Thus, the pixel structure (i.e., sub-pixels arrangement of single pixel) may be determined according to the positions <pixel row, pixel column> of the boundary pixels. Also, target sub-pixels for which the dimming operation is performed may be determined according to the sub-boundary flags. In an exemplary embodiment, when the boundary pixel is located in <odd-numbered pixel column, odd-numbered pixel row>, the boundary pixel may include a red color sub-pixel R as a left sub-pixel and a green color sub-pixel G as a right sub-pixel, for example. When the boundary pixel is located in the <odd-numbered pixel column, even-numbered pixel row>, the boundary pixel may include a blue color sub-pixel B as a left sub-pixel and a green color sub-pixel G as a right sub-pixel, for example. When the boundary pixel is located in the <odd-numbered pixel row, odd-numbered pixel column> and the sub-boundary flag is 1, the red color sub-pixel (i.e., the left sub-pixel) included in the boundary pixel is the boundary sub-pixel that is directly adjacent to the inactive region, for example. Therefore, the dimming operation for the red color sub-pixel of the boundary pixel may be performed. When the boundary pixel is located in the <odd-numbered pixel row, odd-numbered pixel column> and the sub-boundary flag is 0, the green color sub-pixel (i.e., the right sub-pixel) included in the boundary pixel is the boundary sub-pixel that is directly adjacent to the inactive region, for example. Therefore, the dimming operation for the green color sub-pixel of the boundary pixel may be performed.

As shown in FIG. 5, the active region AA and the inactive region IA may be distinguished from each other based on the boundary line BL. In an exemplary embodiment, when the third and fourth pixels PX3 and PX4 among the first to fourth pixels PX1 to PX4 may be boundary pixels that are located in the active region AA and adjacent to the inactive region IA, for example. The left sub-pixel of the third pixel PX3 may be located in the inactive region IA. The right sub-pixel of the third pixel PX3 may be located in the active region AA and may be directly adjacent to the inactive region IA. Therefore, the right sub-pixel of the third pixel PX3 may be determined as the boundary sub-pixel. Accordingly, the dimming operation for the green color sub-pixel of the third pixel PX3 may be performed. The left sub-pixel of the fourth pixel PX4 may be located in the active region AA and may be directly adjacent to the inactive region IA. Accordingly, the dimming operation for red color sub-pixel (i.e., left sub-pixel) of the fourth pixel PX4 may be performed.

Figure 6A:
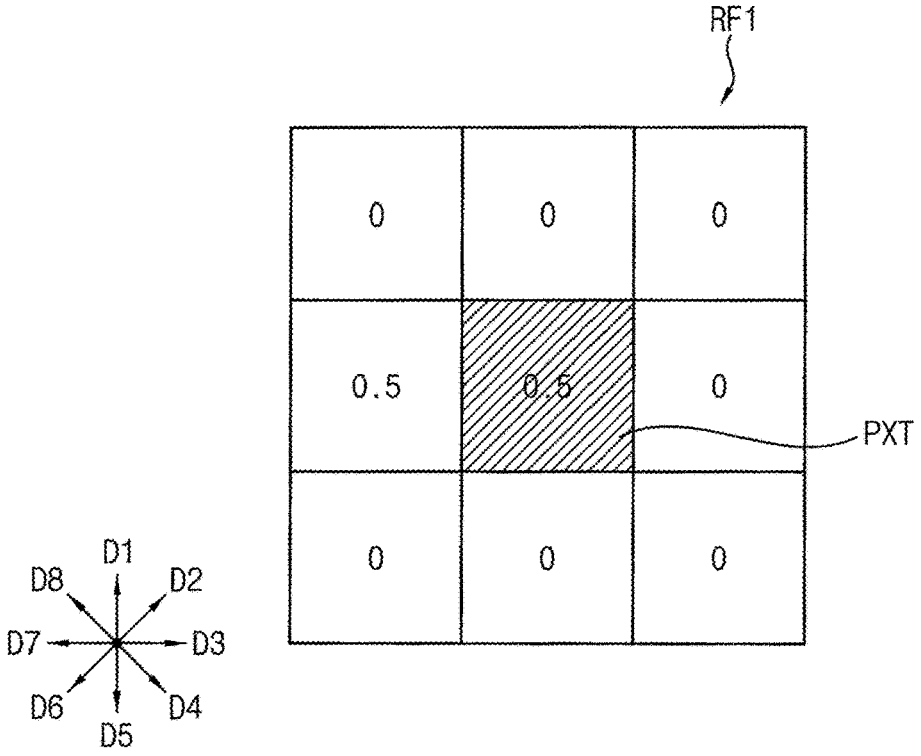
FIGS. 6A and 6B are diagrams illustrating one example in which an image processor of FIG. 2 performs a rendering operation.
Figure 6B:
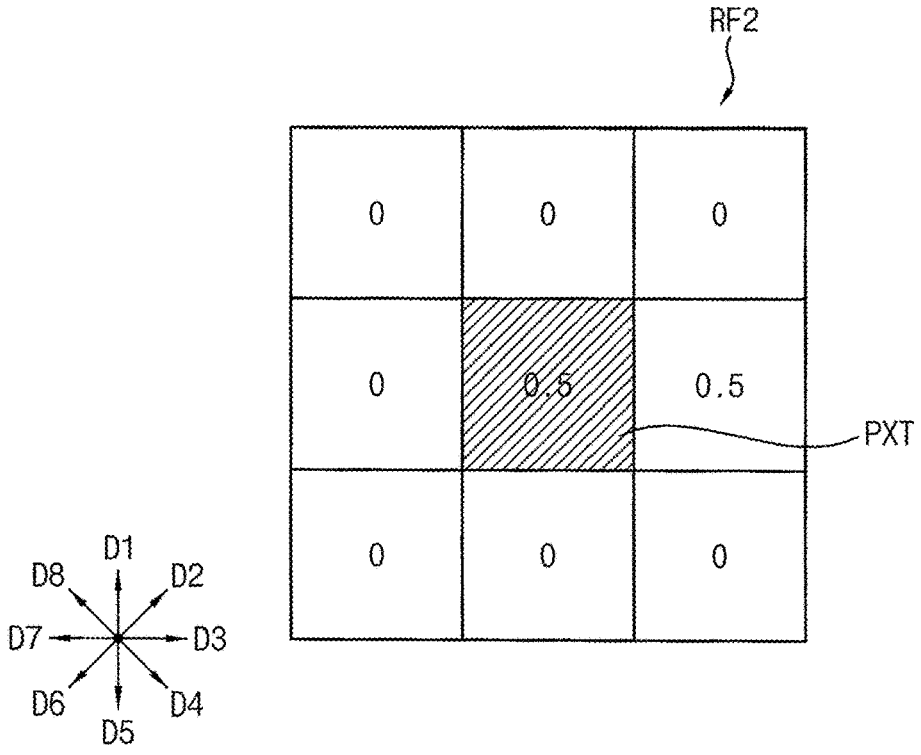
Figure 7A:
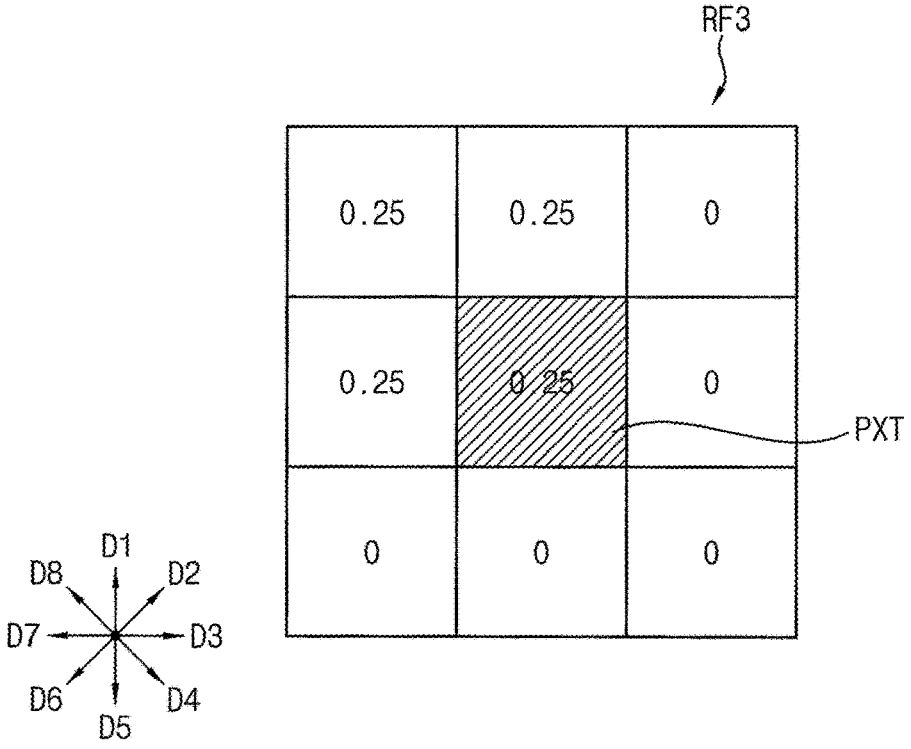
FIGS. 7A and 7B are diagrams illustrating another example in which an image processor of FIG. 2 performs a rendering operation.
Figure 7B:
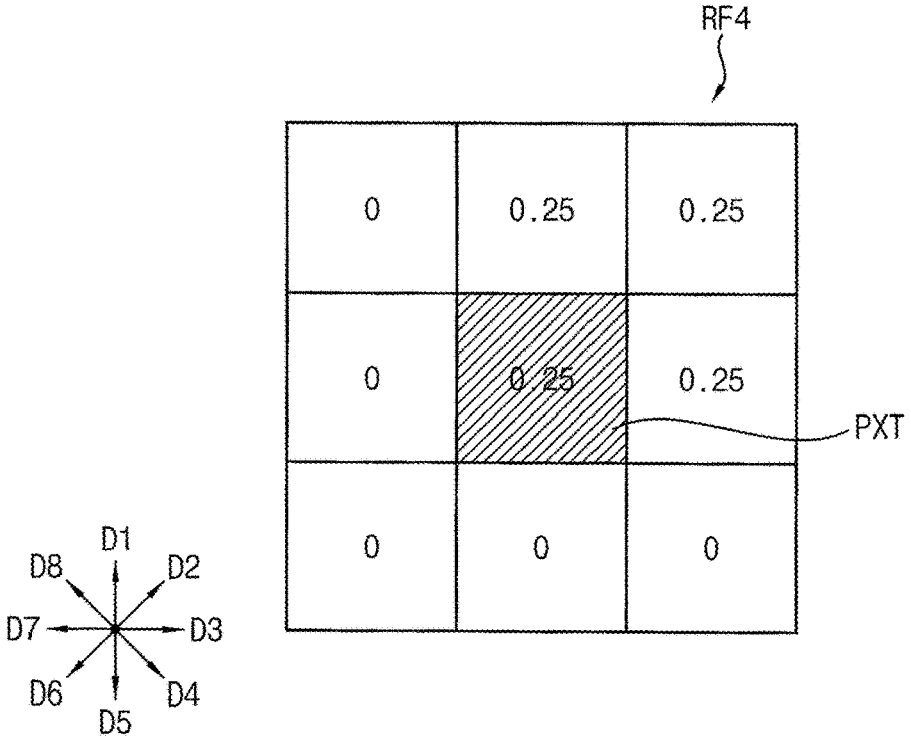
Figure 8:
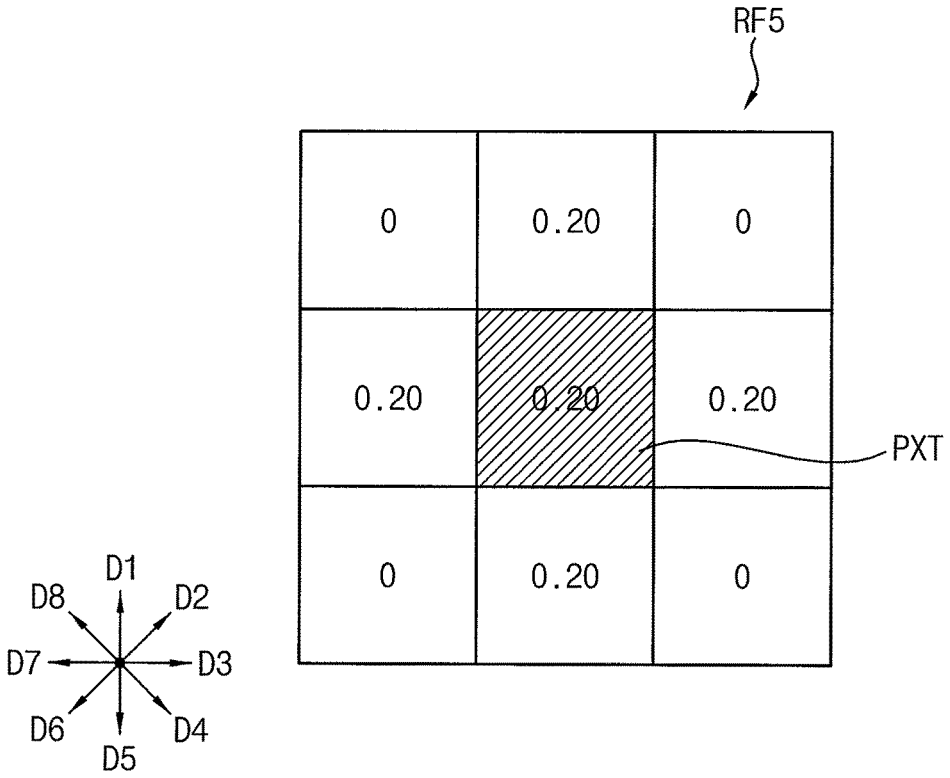
FIG. 8 is a diagram illustrating still another example in which an image processor of FIG. 2 performs a rendering operation.

FIGS. 6A and 6B are diagrams illustrating one example in which an image processor 500 of FIG. 2 performs a rendering operation. FIGS. 7A and 7B are diagrams illustrating another example in which an image processor 500 of FIG. 2 performs a rendering operation. FIG. 8 is a diagram illustrating still another example in which an image processor 500 of FIG. 2 performs a rendering operation.

Referring to FIGS. 6A, 6B, 7A, 7B, and 8, the image processor may set image data of the inactive region IA to dummy data, and may perform the rendering operation with at least one rendering filter for the boundary pixels using the dummy data.

As shown in FIGS. 6A and 6B, the rendering operation to which a different rendering filter is applied according to a direction in which the boundary pixel is adjacent to the inactive region IA may be performed using a line memory in which image data of a single pixel row are stored. In an exemplary embodiment, in the display panel of FIG. 3A, boundary pixels adjacent to the first inactive region IA1 or the third inactive region IA3 may be adjacent to the inactive region in a seventh direction D7, for example. Therefore, a first rendering filter RF1 may be applied to the boundary pixels adjacent to the first inactive region IA1 or the third inactive region IA3. Here, when the first rendering filter RF1 is applied to the rendering operation, image data of the target pixel PXT for which the rendering operation is perform may be equally distributed (or compensated) with respect to a pixel adjacent to the target pixel PXT in the seventh direction D7. Boundary pixels adjacent to the second inactive region IA2 or the fourth inactive region IA4 may be adjacent to the inactive region in a third direction D3. Therefore, a second rendering filter RF2 may be applied to the boundary pixels adjacent to the second inactive region IA2 or the fourth inactive region IA4. Here, when the second rendering filter RF2 is applied to the rendering operation, image data of the target pixel PXT may be equally distributed with respect to a pixel adjacent to the target pixel PXT in the third direction D3. In one exemplary embodiment, when the first rendering filter RF1 or the second rendering filter RF2 is applied the rendering operation, output data of the boundary pixel may be determined according to [Equation 1].

$$OD = \sqrt[2.2]{\left(\frac{(ap/255)^{2.2}}{2} + \frac{(bp/255)^{2.2}}{2}\right)}, \quad \text{[Equation 1]}$$

where OD indicates output image data of boundary sub-pixel, ap indicates the second input image data of a pixel adjacent to the boundary sub-pixel, and bp indicates the first input image data ID1 (refer to FIG. 2) of the boundary sub-pixel.

As shown in FIGS. 7A and 7B, the rendering operation to which a different rendering filter is applied according to a direction in which the boundary pixel is adjacent to the inactive region IA (refer to FIG. 5) may be performed using a line memory in which image data of two pixel rows are stored. In an exemplary embodiment, in the display panel 100A of FIG. 3A, boundary pixels adjacent to the first inactive region IA1 may be adjacent to the first inactive region IA1 in first, seventh, and eighth directions D1, D7, and D8, for example. Therefore, a third rendering filter RF3 may be applied to the boundary pixels adjacent to the first inactive region IA1. Here, since the third rendering filter RF3 is applied to the rendering operation, image data of the target pixel PXT may be equally distributed (or compensated) with respect to pixels adjacent to the target pixel PXT in the first, seventh, and eighth directions D1, D7, D8. Boundary pixels adjacent to the second inactive region IA2 may be adjacent to the second inactive region IA2 in the first, second, and third directions D1, D2, D3. Therefore, a fourth rendering filter RF4 may be applied to the boundary pixels adjacent to the second inactive region IA2. Here, since the fourth rendering filter RF4 is applied to the rendering operation, image data of the target pixel PXT may be equally distributed with respect to pixels adjacent to the target pixel PXT in the first, second, and third directions D1, D2, D3. In addition, the third rendering filter RF3 may be applied to boundary pixels adjacent to the third inactive region IA3. The fourth rendering filter RF4 may be applied to boundary pixels adjacent to the fourth inactive region IA4. In this case, luminance of the boundary pixels adjacent to the third inactive region IA3 or the fourth inactive region IA4 may be greater than luminance of the boundary pixels adjacent to the first inactive region IA1 or the second inactive region IA2. Therefore, a first dimming level for boundary pixels adjacent to the third inactive region IA3 or the fourth inactive region IA4 may be higher than a second dimming level for boundary pixels adjacent to the first inactive region IA1 or the second inactive region IA2 to reduce the luminance deviation.

As shown in FIG. 8, the rendering operation to which a different rendering filter is applied according to a direction in which the boundary pixel is adjacent to the inactive region may be performed using a line memory in which image data of three pixel rows are stored. In an exemplary embodiment, in the display panel of FIG. 3A, a fifth rendering filter RF5 may be applied to entire display panel, for example. Here, the fifth rendering filter RF5 is applied to the rendering operation, image data of the target pixel PXT may be equally distributed (or compensated) with respect to a pixel adjacent to the target pixel PXT in the first, third, fifth, and seventh directions D1, D3, D5, and D7.

Figure 9A:
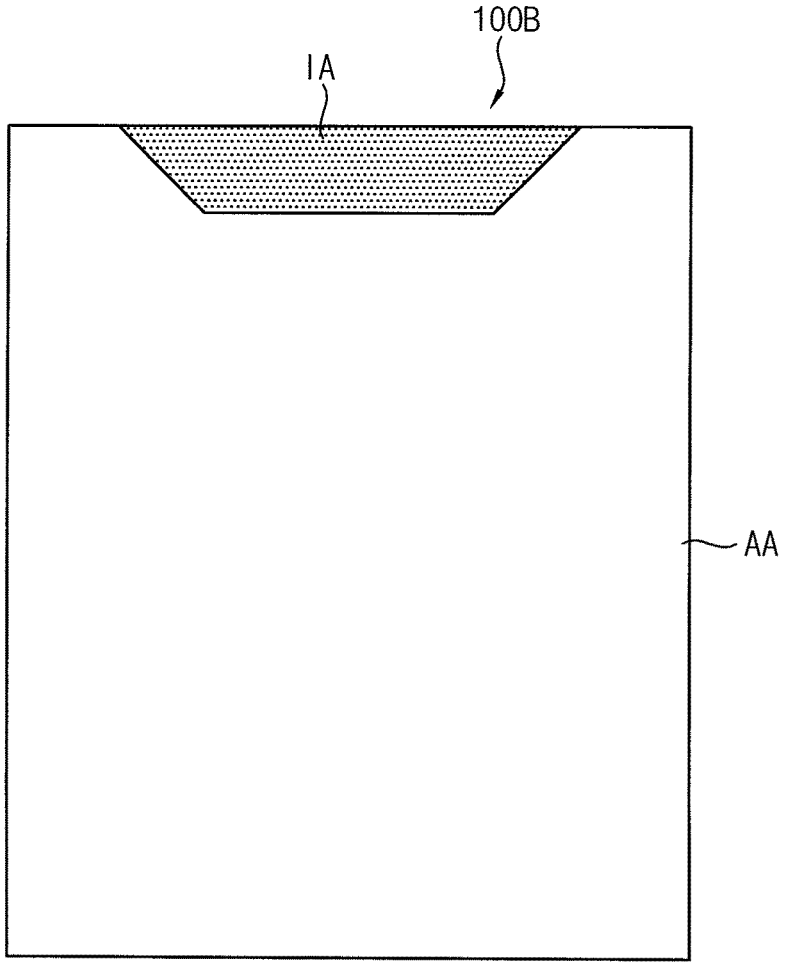
FIGS. 9A and 9B are diagrams illustrating another example of a display panel included in a display device of FIG. 1.
Figure 9A:
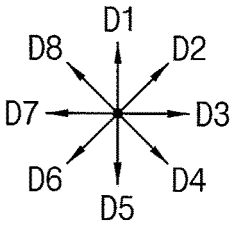
Figure 9B:
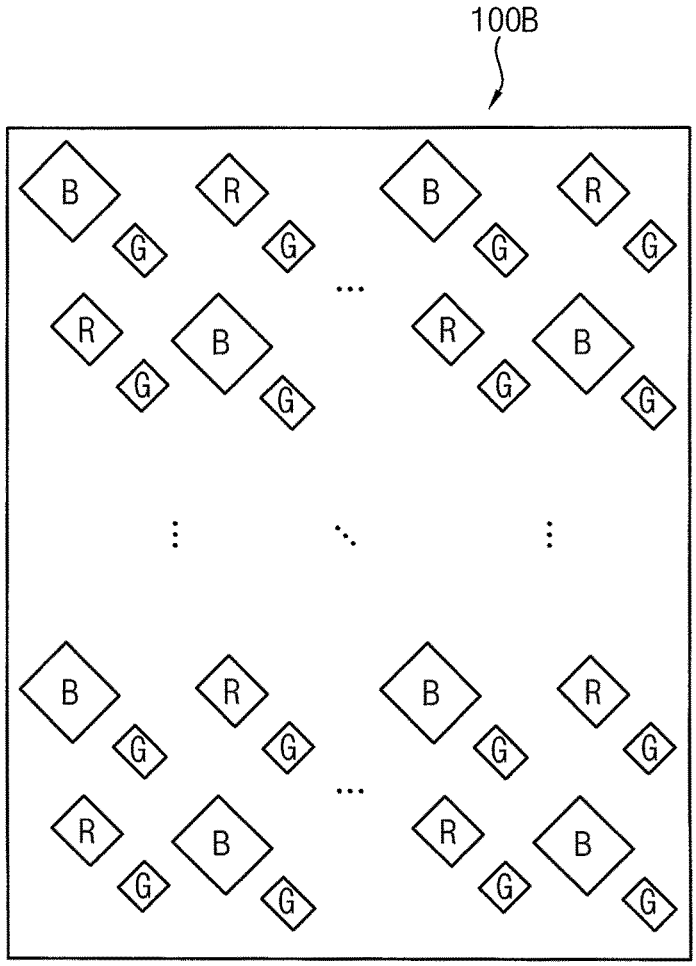
Figure 9B:
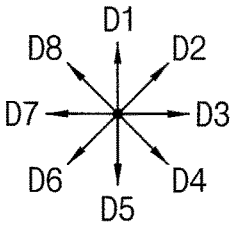
Figure 10A:
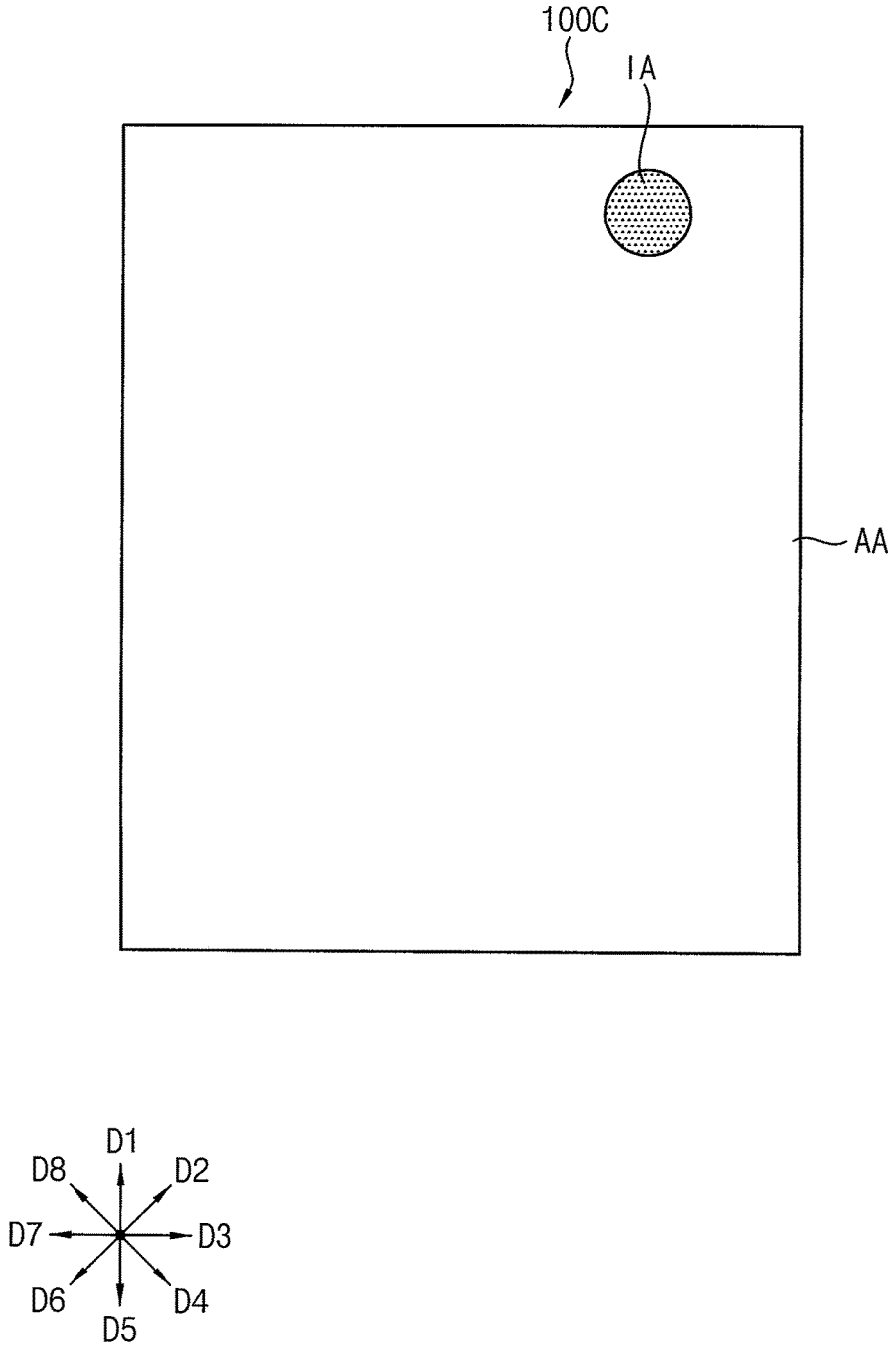
FIGS. 10A and 10B are diagrams illustrating still another example of a display panel included in a display device of FIG. 1.
Figure 10B:
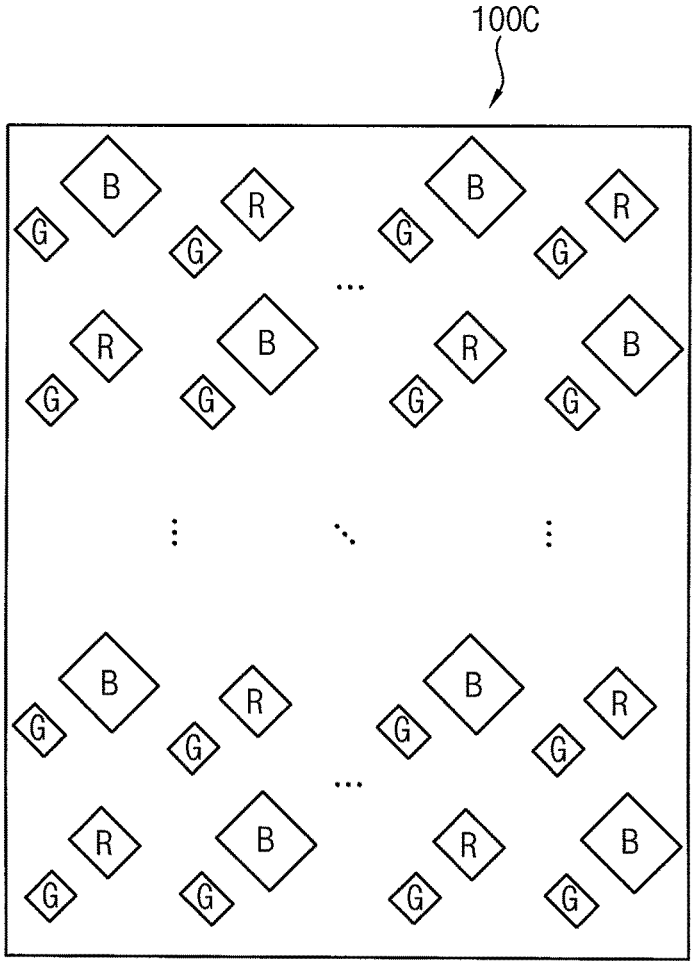
Figure 10B:
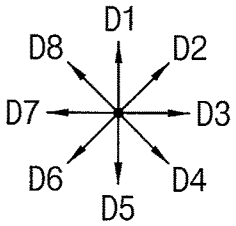

FIGS. 9A and 9B are diagrams illustrating another example of a display panel included in a display device of FIG. 1. FIGS. 10A and 10B are diagrams illustrating still another example of a display panel included in a display device of FIG. 1.

Referring to FIGS. 9A, 9B, 10A, and 10B, the display panel 100B and 100C may include pixels arranged in a pentile matrix structure, and may be divided into an active region AA in which an image is displayed and an inactive region IA adjacent to the active region AA.

In one exemplary embodiment, as shown in FIG. 9A, the inactive region IA of the display panel 100B may be folded inwardly so as to be invisible to the user, or may be a virtual region that has been cut to meet a design requirement (e.g., button insertion, etc.).

As shown in FIG. 9B, the display panel 100B may include a pixel array in which a third pixel including a blue color sub-pixel B and a green color sub-pixel G and a fourth pixel including a red color sub-pixel R and a green color sub-pixel G are alternately arranged (hereinafter, referred to as a BGRG pentile matrix structure).

In another exemplary embodiment, as shown in FIG. 10A, the inactive region IA of the display panel 100C may be surrounded by the active region AA. In an exemplary embodiment, the inactive region IA of the display panel 100C may be a virtual region generated by a hole inside the active region AA to meet a design requirement (e.g., camera insertion, etc.), for example.

As shown in FIG. 10B, the display panel 100C may include a pixel array in which a fifth pixel including a green color sub-pixel G and a blue color sub-pixel B and a sixth pixel including a green color sub-pixel G and a red color sub-pixel R are alternately arranged (hereinafter, referred to as a GBGR pentile matrix structure).

Since the color bands may be recognized by the user due to the asymmetrical pixel arrangement at the edge portion of the active region AA, the color band problem may be prevented by performing the dimming operation or the rendering operation for the boundary pixels based on the pixel arrangement data AD (refer to FIG. 2).

Figure 11:
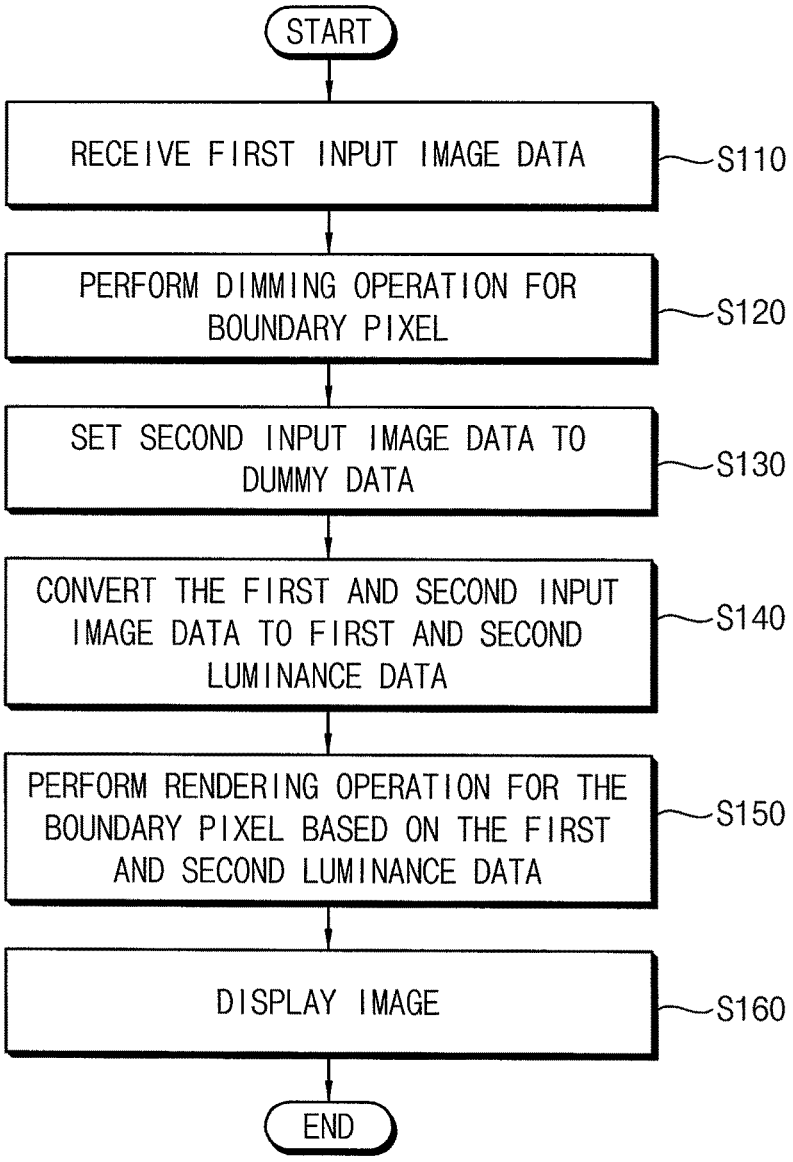
FIG. 11 is a flow chart illustrating an exemplary embodiment of a method of driving a display device.

FIG. 11 is a flow chart illustrating a method of driving a display device according to one exemplary embodiment.

Referring to FIG. 11, a method of driving a display device may set image data of the inactive region IA (refer to FIGS. 5, 9A and 10A) to dummy data and may perform the rendering operation for the boundary pixel using the dummy data. Accordingly, the color band problem occurring in the edge portion of the display device having various shapes may be prevented and a display quality may be improved.

Specifically, first input image data ID1 (refer to FIG. 2) corresponding to the active region AA (refer to FIGS. 3A, 5, 9A and 10A) may be received (S110).

A dimming operation for the first input image data ID1 corresponding to the boundary pixel may be performed based on pixel arrangement data AD (refer to FIG. 2) to lower a luminance of the boundary pixel or the boundary sub-pixel (S120). In one exemplary embodiment, the dimming operation may have a first dimming level when the boundary pixel is adjacent to the inactive region IA in the first direction. The dimming operation may have a second dimming level different from the first dimming level when the boundary pixel is adjacent to the inactive region IA in the second direction different from the first direction. In one exemplary embodiment, the dimming operation may be performed for a selected one of sub-pixels included in the boundary pixel. Since the method of performing the diming operation is described above, duplicated descriptions will be omitted.

The second input image data corresponding to the inactive region IA may be set to the dummy data (S130). In one exemplary embodiment, the dummy data may be determined as black color image data, for example. In another exemplary embodiment, the dummy data may be determined such that a grayscale value of the dummy data increases as an average grayscale value of the first input image data ID1 increases. In still another exemplary embodiment, the dummy data may be determined as a first grayscale value when the boundary pixel is adjacent to the inactive region IA in a first direction, and may be determined as a second grayscale value different from the first grayscale value when the boundary pixel is adjacent to the inactive region IA in a second direction different from the first direction.

The first input image data ID1 may be converted into first luminance data LD1 (refer to FIG. 2), and the second input image data may be converted into second luminance data LD2 (refer to FIG. 2) (S140).

A rendering operation for a boundary pixel may be performed based on the first luminance data LD1 and the second luminance data LD2 to generate output image data OD (refer to FIG. 2) (S150). Here, the boundary pixel may be located in the active region AA and may be adjacent to the inactive region IA. In one exemplary embodiment, the rendering operation for entire display panel may be performed using the same rendering filter. In another exemplary embodiment, the rendering operation for the boundary pixel may be performed using a first rendering filter RF1 (refer to FIG. 6A) when the boundary pixel is adjacent to the inactive region IA in a first direction, and may be performed using a second rendering filter RF2 (refer to FIG. 6B) different from the first rendering filter RF1 when the boundary pixel is adjacent to the inactive region IA in a second direction different from the first direction. Since the methods of determining the dummy data and performing the rendering operation are described above, duplicated descriptions will be omitted.

An image corresponding to the output image data OD may be displayed (S160).

Although the exemplary embodiments describe that the rendering operation has one or two rendering filters, the invention is not limited thereto. The rendering operation may apply three or more different rendering filters depending on the position of the display panel.

Although a method of driving display device and a display device for performing the method according to exemplary embodiments have been described with reference to drawings, those skilled in the art will readily appreciate that many modifications are possible in the exemplary embodiments without materially departing from the novel teachings and advantages of the invention. In an exemplary embodiment, although the exemplary embodiments describe that the display device is organic light emitting display device, a type of the display device is not limited thereto, for example.

The invention may be applied to an electronic device having the display device. In an exemplary embodiment, the invention may be applied to a computer monitor, a laptop computer, a cellular phone, a smart phone, a smart pad, a personal digital assistant ("PDA"), etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel which includes a plurality of pixels, and has an active region in which an image is displayed and an inactive region adjacent to the active region, where a boundary between the active region and the inactive region has a curved line shape;

an image processor which sets image data of the inactive region to dummy data, and performs a rendering operation for a boundary pixel of the plurality of pixels based on the dummy data to generate output image data, the boundary pixel located in the active region and adjacent to the inactive region; and a panel driver which provides a driving signal to the display panel to display the image corresponding to the output image data, wherein the image processor receives first input image data corresponding to the active region, sets second input image data corresponding to the inactive region based on the dummy data, and performs a dimming operation for the first input image data corresponding to the boundary pixel based on pixel arrangement data including position data of the boundary pixel.

2. The display device of claim 1, wherein the image processor converts the first input image data to first luminance data, converts the second input image data to second luminance data, generates rendering data by performing the rendering operation for the boundary pixel based on the first luminance data and the second luminance data, and converts the rendering data to the output image data.

3. The display device of claim 2, wherein the dummy data setter determines the dummy data as black color image data.

4. The display device of claim 2, wherein the dummy data setter determines the dummy data based on the first input image data.

5. The display device of claim 4, wherein the dummy data setter determines the dummy data such that a grayscale value of the dummy data increases as an average grayscale value of the first input image data increases.

6. The display device of claim 2, wherein the dummy data setter determines the dummy data as a first grayscale value when the boundary pixel is adjacent to the inactive region in a first direction, and determines the dummy data as a second grayscale value different from the first grayscale value when the boundary pixel is adjacent to the inactive region in a second direction different from the first direction.

7. The display device of claim 2, wherein the rendering processor performs the rendering operation for the boundary pixel using a first rendering filter when the boundary pixel is adjacent to the inactive region in a first direction, and performs the rendering operation for the boundary pixel using a second rendering filter different from the first rendering filter when the boundary pixel is adjacent to the inactive region in a second direction different from the first direction.

8. The display device of claim 1, wherein the dimming operation has a first dimming level when the boundary pixel is adjacent to the inactive region in a first direction, and has a second dimming level different from the first dimming level when the boundary pixel is adjacent to the inactive region in a second direction different from the first direction.

9. The display device of claim 1, wherein the dimming processor performs the dimming operation for one of sub-pixels included in the boundary pixel.

10. A method of driving a display device which comprises a display panel including a plurality of pixels, and has an active region in which an image is displayed and an inactive region adjacent to the active region, where a boundary between the active region and the inactive region has a curved line shape, the method comprising:

receiving first input image data corresponding to the active region;

setting second input image data corresponding to the inactive region to dummy data;

converting the first input image data to first luminance data and converting the second input image data to second luminance data;

performing a rendering operation for a boundary pixel of the plurality of pixels based on the first luminance data and the second luminance data to generate output image data, the boundary pixel located in the active region and adjacent to the inactive region;

performing a dimming operation for the first input image data corresponding to the boundary pixel based on pixel arrangement data including position data of the boundary pixel; and displaying the image corresponding to the output image data.

11. The method of claim 10, wherein the dummy data corresponds to black color image data.

12. The method of claim 10, wherein grayscale values of the dummy data increase as an average grayscale value of the first input image data increases.

13. The method of claim 10, wherein the dummy data are determined as a first grayscale value when the boundary pixel is adjacent to the inactive region in a first direction, and are determined as a second grayscale value different from the first grayscale value when the boundary pixel is adjacent to the inactive region in a second direction different from the first direction.

14. The method of claim 10, wherein the rendering operation for the boundary pixel uses a first rendering filter when the boundary pixel is adjacent to the inactive region in a first direction, and uses a second rendering filter different from the first rendering filter when the boundary pixel is adjacent to the inactive region in a second direction different from the first direction.

15. The method of claim 10, wherein the dimming operation has a first dimming level when the boundary pixel is adjacent to the inactive region in a first direction, and has a second dimming level different from the first dimming level when the boundary pixel is adjacent to the inactive region in a second direction different from the first direction.

16. The method of claim 10, wherein the dimming operation is for one of sub-pixels included in the boundary pixel.

17. A method of driving a display device which comprises a display panel including a plurality of pixels, and has an active region in which an image is displayed and an inactive region adjacent to the active region, where a boundary between the active region and the inactive region has a curved line shape, the method comprising:

setting image data of the inactive region to dummy data;

performing a rendering operation for a boundary pixel of the plurality of pixels based on the dummy data to generate output image data, the boundary pixel located in the active region and adjacent to the inactive region; and displaying the image corresponding to the output image data, wherein the rendering operation for the boundary pixel uses a first rendering filter when the boundary pixel is adjacent to the inactive region in a first direction, and uses a second rendering filter different from the first rendering filter when the boundary pixel is adjacent to the inactive region in a second direction different from the first direction.

* * * * *